US012589322B1

(12) United States Patent
Chuanzhan

(10) Patent No.: US 12,589,322 B1
(45) **Date of Patent: *Mar. 31, 2026**

(54) MAGNETIC BUILDING BLOCK

(71) Applicant: Shenzhenshi Libyankejiyouxiangongsi, Guang Dong Sheng (CN)

(72) Inventor: Li Chuanzhan, Guang Dong Sheng (CN)

(73) Assignee: Shenzhenshi Libyankejiyouxiangongsi, Guang Dong Sheng (TW)

( * ) Notice: Subject to any disclaimer, the term of this patent is extended or adjusted under 35 U.S.C. 154(b) by 0 days.

This patent is subject to a terminal disclaimer.

(21) Appl. No.: 19/302,669

(22) Filed: Aug. 18, 2025

Related U.S. Application Data

(63) Continuation of application No. 19/297,876, filed on Aug. 12, 2025.

(51) Int. Cl.
*A63H 33/04* (2006.01)
*A63H 33/26* (2006.01)

(52) U.S. Cl.
CPC ..... *A63H 33/046* (2013.01)

(58) Field of Classification Search
CPC .... A63H 33/046; A63H 33/06; A63H 33/086; A63H 33/10; A63H 33/26
USPC ..... 446/85, 92, 124, 129
See application file for complete search history.

(56) References Cited

U.S. PATENT DOCUMENTS

| | | | | |
|---|---|---|---|---|
| 2,939,243 | A * | 6/1960 | Duggar | A63H 33/046 446/92 |
| 3,254,440 | A * | 6/1966 | Duggar | A63H 33/046 446/92 |
| 3,601,921 | A * | 8/1971 | Strohmaier | A63H 33/046 446/92 |
| 6,024,626 | A * | 2/2000 | Mendelsohn | A63H 33/046 446/124 |
| 7,160,170 | B2 * | 1/2007 | Yoon | A63H 33/046 273/156 |
| 7,255,624 | B2 * | 8/2007 | Daftari | A63H 33/22 446/485 |
| 8,850,683 | B2 * | 10/2014 | Haughey | A63H 33/046 446/124 |
| 9,751,025 | B2 * | 9/2017 | Kiribuchi | A63H 33/046 |
| 9,814,998 | B2 * | 11/2017 | Wei | A63H 33/046 |
| 9,873,062 | B2 * | 1/2018 | Purns | A63H 33/06 |
| 11,103,801 | B2 * | 8/2021 | Vicentelli | A63H 33/06 |

(Continued)

*Primary Examiner* — Alexander R Niconovich
(74) *Attorney, Agent, or Firm* — Calderon Safran & Wright P.C.

(57) ABSTRACT

A magnetic building block includes a pair of clamshell structures, each formed as a parallelepiped with an open side and attachment tubes extending from end walls toward the open sides. An attachment bracket with opposing sides and multiple posts fits into corresponding attachment tubes to join the clamshells. Corner walls extend toward the open sides at each corner, and magnets are positioned on extension tubes that project perpendicularly from the bracket sides. Ledges surround the bracket edges to form structural plates. Posts and extension tubes have specified geometries, with hollow tubes supporting magnets and solid cylindrical posts affixed to paraboloid bases. The structural arrangement permits modular assembly and magnetic connectivity across multiple axes.

3 Claims, 5 Drawing Sheets

(56) References Cited

U.S. PATENT DOCUMENTS

| | | | | |
|---|---|---|---|---|
| 11,207,609 | B2 * | 12/2021 | Rosen | A63H 33/046 |
| 11,224,821 | B2 * | 1/2022 | Rosen | H01F 7/0221 |
| 11,406,909 | B2 * | 8/2022 | Zhang | A63H 33/26 |
| 11,458,410 | B2 * | 10/2022 | Xu | A63H 33/046 |
| 11,766,622 | B1 * | 9/2023 | Chen | A63H 33/046 446/92 |
| 11,904,254 | B2 * | 2/2024 | Hart | A63H 33/046 |
| 12,151,182 | B2 * | 11/2024 | Chen | A63H 33/046 |
| 12,350,603 | B1 * | 7/2025 | Lu | F21V 23/04 |
| 12,377,363 | B1 * | 8/2025 | Li | A63H 33/046 |
| 12,491,449 | B1 * | 12/2025 | Huang | A63H 33/046 |
| 2010/0120322 | A1 * | 5/2010 | Vicentelli | A63H 33/046 446/92 |
| 2012/0309259 | A1 * | 12/2012 | Mak | A63H 33/046 446/92 |
| 2015/0065007 | A1 * | 3/2015 | Klepper | A63H 33/046 446/92 |
| 2015/0258462 | A1 * | 9/2015 | Wei | A63H 33/06 446/92 |
| 2019/0201804 | A1 * | 7/2019 | Khalus | A63H 33/046 |
| 2022/0241698 | A1 * | 8/2022 | Jungco | A63H 33/046 |
| 2024/0238689 | A1 * | 7/2024 | Chen | A63H 33/046 |
| 2025/0058243 | A1 * | 2/2025 | Chen | A63H 33/046 |

* cited by examiner

MAGNETIC BUILDING BLOCK

BACKGROUND

Building blocks with magnetic connectors have become popular educational and recreational tools. Embodiments of the disclosed invention address challenges in creating magnetic building blocks that offer both structural integrity and modular assembly flexibility. Some approaches in this field include those shown in U.S. Pat. No. 11,766,622 B1 issued to Chen and U.S. Patent Application Publication No. 2015/0065007 A1 filed by Klepper. Embodiments of the disclosed invention provide a modular structure that can be assembled in a structurally sound manner.

SUMMARY

The present invention relates to a magnetic building block comprised of two clamshell components that are mechanically and magnetically joined using an attachment bracket and a system of posts, tubes, corner walls, and magnets. Each clamshell is a hollow, open-sided parallelepiped structure defined by an end wall and four side walls, with each side wall centrally supporting an attachment tube extending toward the open side. The two clamshells are configured to be joined together by an attachment bracket having two opposing sides and four edges, each side bearing centrally located solid posts at each edge. These posts feature a design combining cylindrical elements with paraboloid bases, and are sized and positioned to fit within the corresponding attachment tubes of the first and second clamshells, thereby structurally uniting the clamshells into a single modular unit.

At each corner of the clamshells, corner walls extend from the end wall and adjacent side walls toward the open side to reinforce the structure and serve as anchor points for magnetic coupling. Extension tubes project perpendicularly from each side of the attachment bracket, with each tube supporting a magnet positioned at a corner corresponding to those formed by the clamshells. These magnets enable magnetic connectivity between adjacent blocks along multiple axes and at various orientations.

Each extension tube is a hollow structure of a first height, while each post consists of a solid cylindrical element joined to a paraboloid base of a second, shorter height. The relative heights of these components contribute to stability and modular engagement during assembly.

The outer edges of the attachment bracket are reinforced with peripheral ledges that are more than twice the thickness of the bracket itself. These ledges define first and second structural plates on opposing sides of the bracket, contributing to the structural rigidity and alignment of the joined clamshells by functioning as mechanical stops that prevent over-insertion of the bracket.

Through this combination of mechanical interlocks and magnetic interfaces, the invention enables modular, multidirectional construction with increased stability, alignment accuracy, and compatibility with additional magnetic building components.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
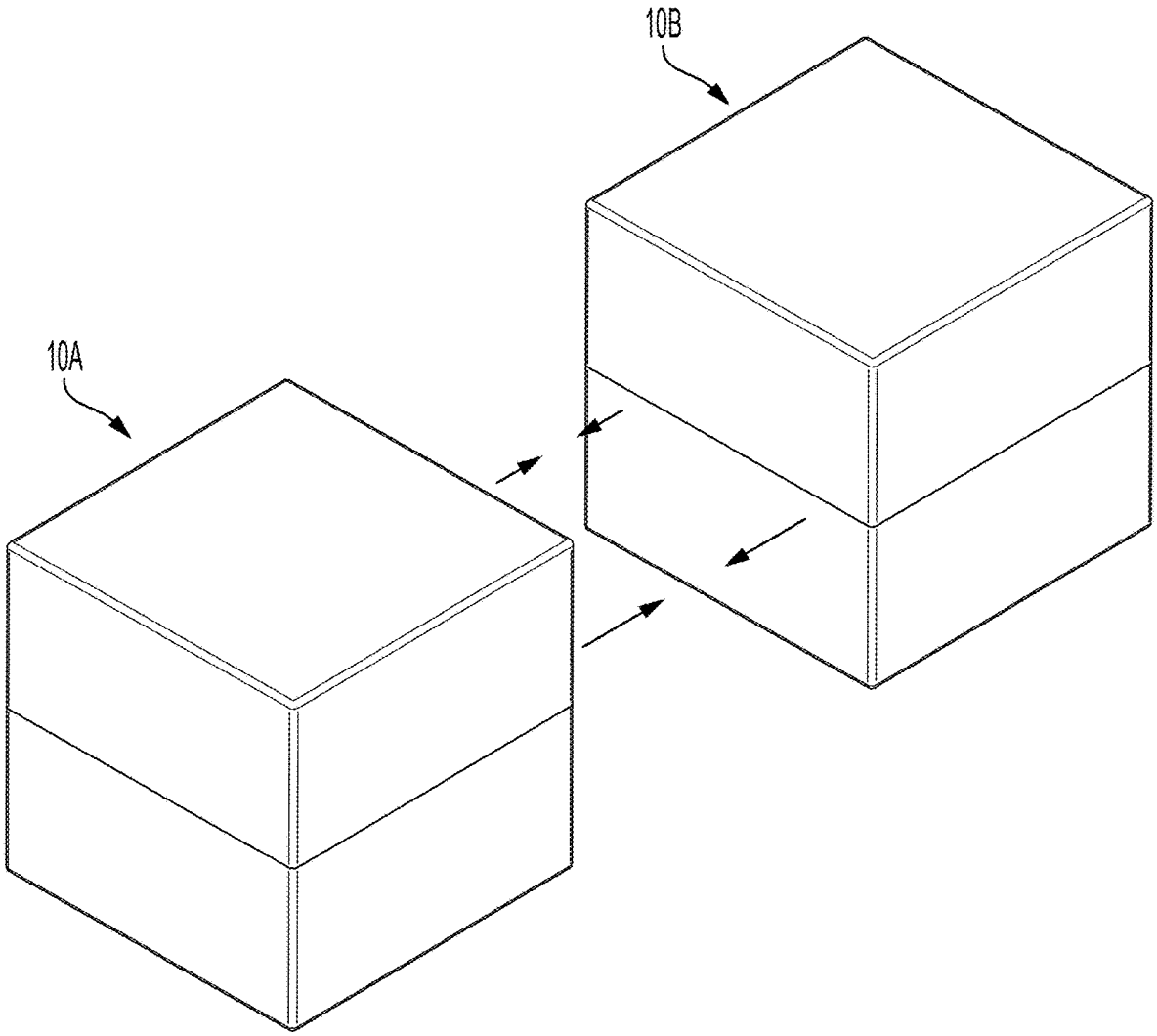
FIG. 1 shows a perspective view of one embodiment of the present invention shown in use.
Figure 2:
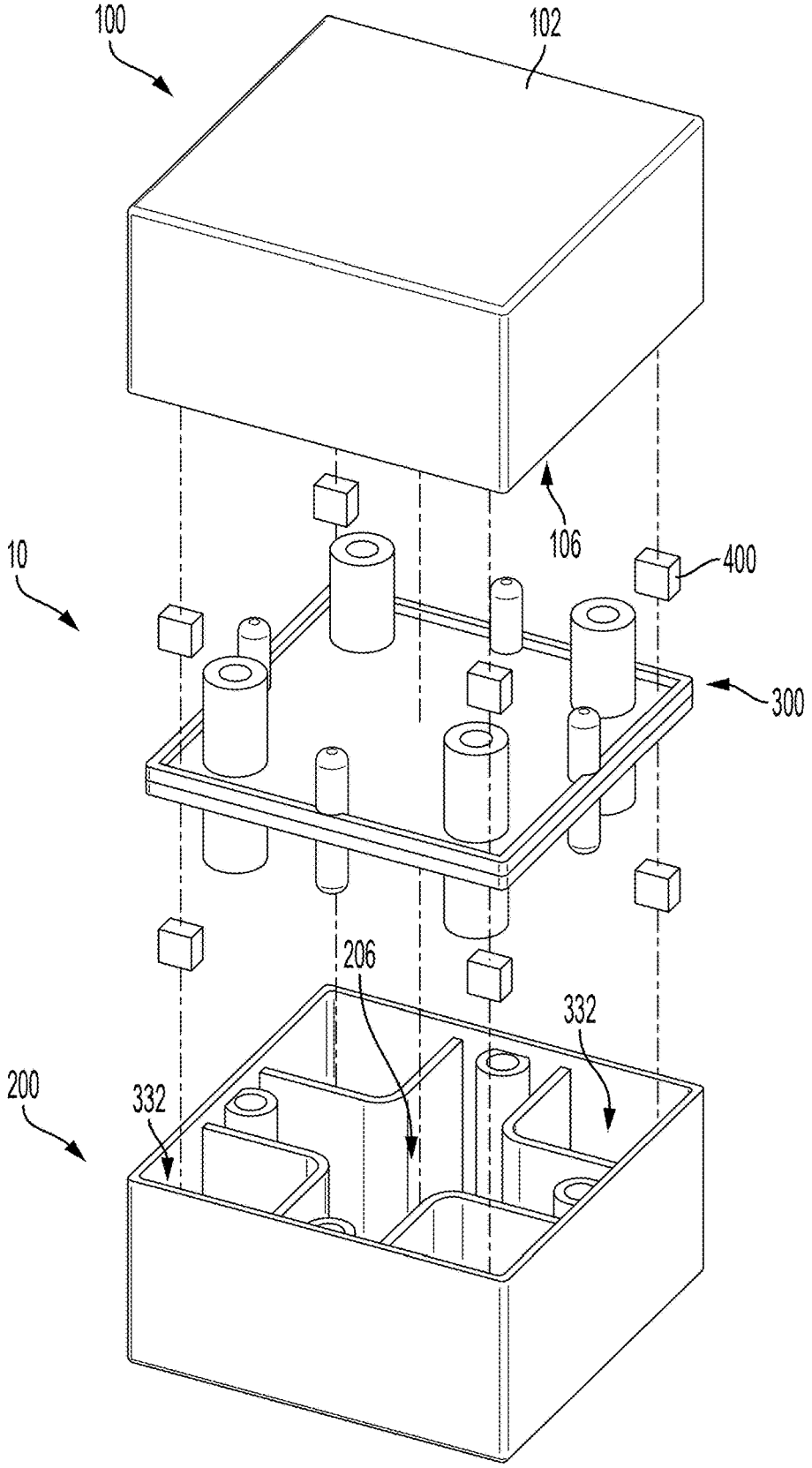
FIG. 2 shows an assembly view of one embodiment of the present invention.
Figure 3A:
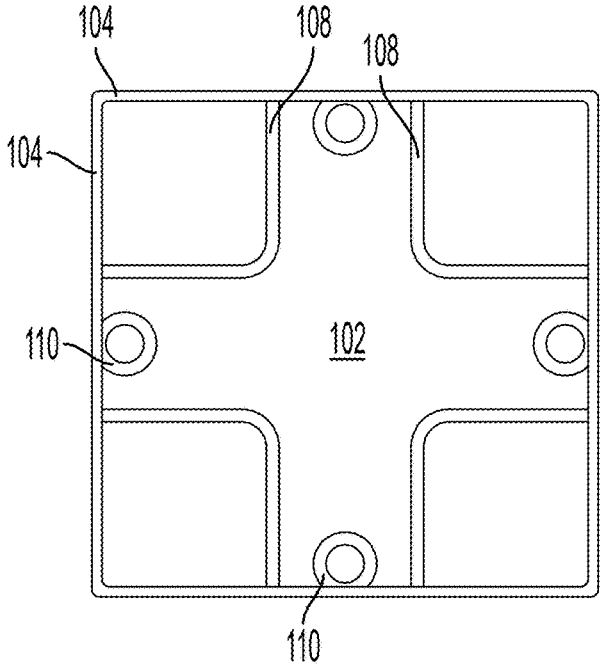
FIG. 3A shows a top view of one embodiment the first clamshell of the present invention.
Figure 3B:
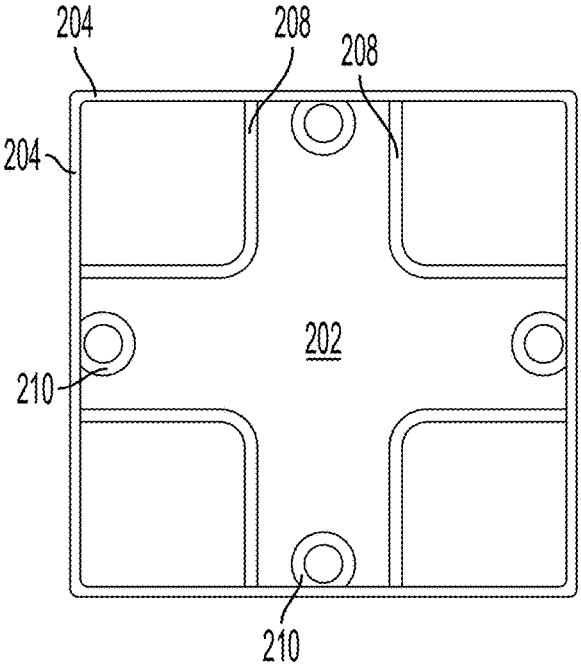
FIG. 3B shows a bottom view of one embodiment the second clamshell of the present invention.
Figure 4A:
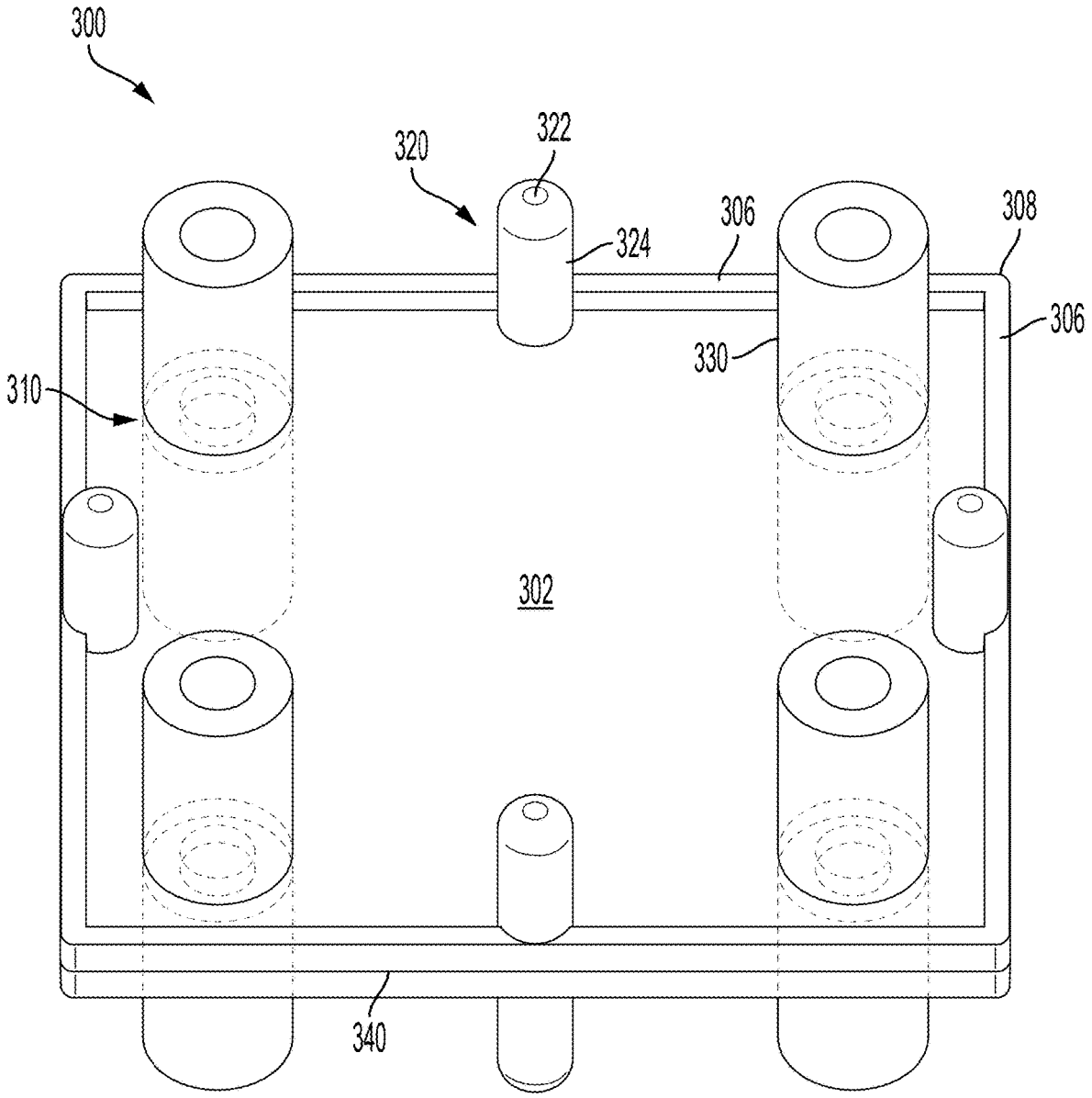
FIG. 4A shows a top view of one embodiment the attachment bracket of the present invention.
Figure 4B:
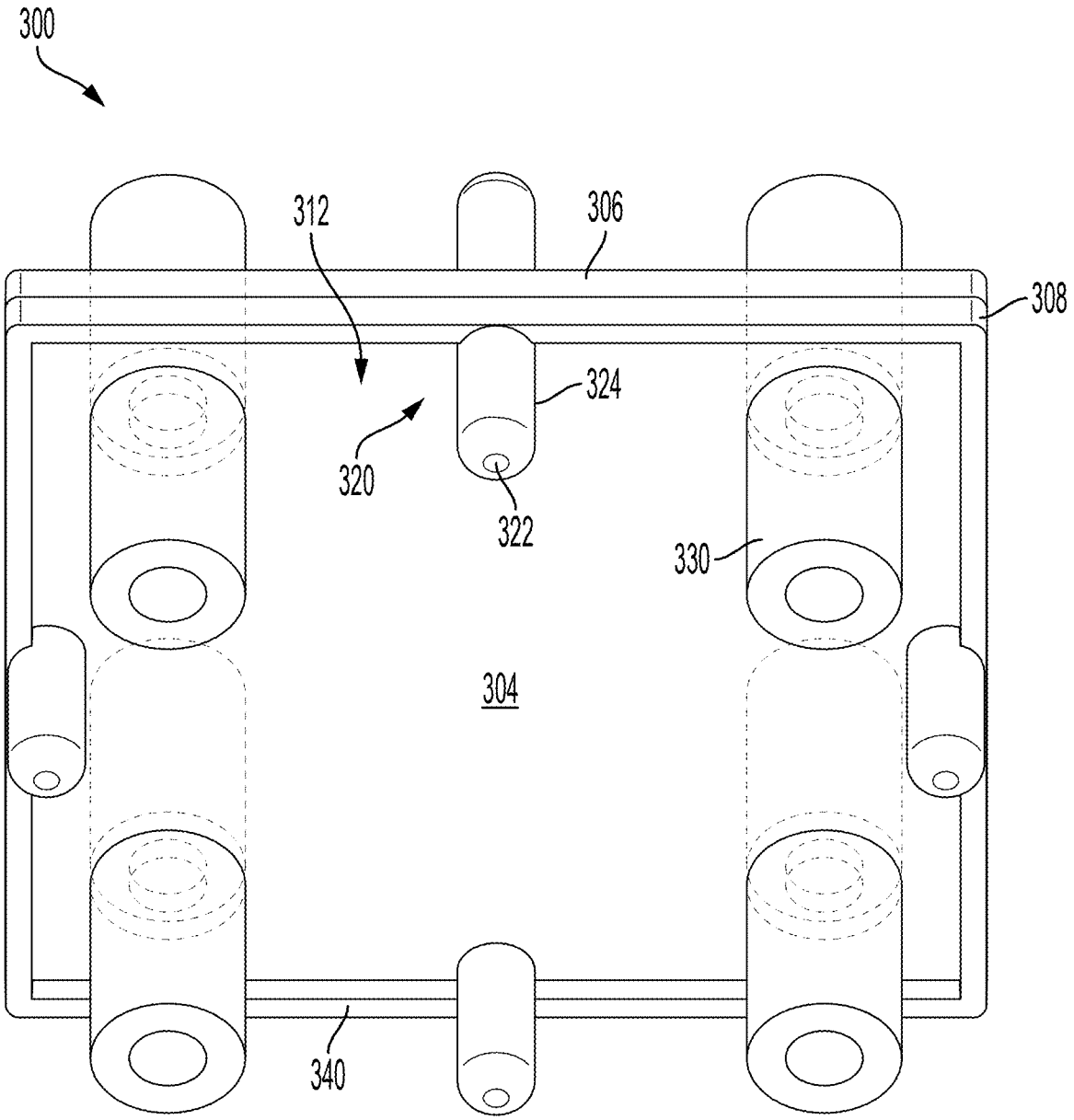
FIG. 4B shows a top view of one embodiment the attachment bracket of the present invention.

By way of example and turning to FIGS. 1-4, embodiments of the present invention relates to a magnetic building block 10A configured for secure and modular interconnection with other like building blocks 10B. The magnetic building block 10 includes a first clamshell 100, a second clamshell 200, an attachment bracket 300, and a set of magnets 400 housed within the attachment bracket.

The first clamshell 100 is a generally hollow enclosure defined by an end wall 102, a plurality of side walls 104, and an open side 106 opposite the end wall. Four corner walls 108 extend inwardly from the intersections of the side walls 104 and end wall 102, each disposed near a corner of the clamshell. These corner walls 108 provide structural reinforcement to the clamshell and serve as anchor points for magnetic coupling. Disposed within the interior of the first clamshell 100 are four attachment tubes 110, each extending inward from the center of one of the side walls 104 toward the open side 106. The central positioning of these attachment tubes contributes to proper alignment and connection with the attachment bracket.

The second clamshell 200 is structurally similar to the first clamshell 100 and includes an end wall 202, side walls 204, an open side 206, corner walls 208, and four attachment tubes 210 arranged in a corresponding configuration. The open side 206 of the second clamshell 200 is configured to face and align with the open side 106 of the first clamshell 100 for assembly.

The attachment bracket 300 comprises a flat plate body having a first side 302, a second side 304, four edges 306, and four corners 308. A first structural plate 310 is defined on the first side 302, and a second structural plate 312 is defined on the second side 304. The bracket 300 further includes four cylindrical posts 320, each extending perpendicularly from one of the four edges 306. Each cylindrical post 320 includes a paraboloid base 322 and an upper cylindrical segment 324. This combination of a paraboloid base with a cylindrical segment provides mechanical stability when inserted into the attachment tubes. These posts 320 are dimensioned to be inserted into the attachment tubes 110 and 210 of the first and second clamshells 100 and 200, thereby securing the bracket 300 between the clamshells.

Each corner 308 of the bracket 300 includes an extension tube 330 that extends perpendicularly from the bracket surface. Each extension tube 330 defines a cavity 332 configured to receive and retain a magnet 400. The magnets 400 are positioned within the extension tubes 330 such that a magnetic pole is exposed consistently across all magnets, enabling attraction to corresponding magnets of other building blocks.

A peripheral ledge 340 extends radially from each of the structural plates 310 and 312. These ledges 340 function as mechanical stops, preventing the over-insertion of the bracket 300 into either clamshell 100 or 200. When assembled, the ledges 340 rest flush against the open rims 106 and 206 of the clamshells, promoting alignment and stability.

Upon full assembly, the cylindrical posts 320 of the bracket 300 frictionally engage the attachment tubes 110 and 210, and the extension tubes 330 nest within the respective corner walls 108 and 208 of the clamshells. The magnets 400 are thus positioned near the outer corners of the assembled building block, enabling reliable and multidirectional magnetic coupling with other blocks of similar construction.

The components of the magnetic building block may be manufactured from polymeric materials, with the bracket 300 formed from a more rigid polymer for structural integrity. The magnets 400 may be rare-earth permanent magnets, such as neodymium, selected for compactness and strong magnetic performance.

In combination, the first clamshell 100, second clamshell 200, attachment bracket 300, and magnets 400 form a modular, durable, and reusable building block system. The components cooperate to provide ease of assembly, magnetic connectivity, and structural stability, allowing users to construct complex configurations of interconnected magnetic blocks.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 6. In particular, any use of "step of" in the claims is not intended to invoke the provision of 35 U.S.C. § 112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A magnetic building block, comprising:

a first clamshell comprising a first clamshell end wall joined to a first clamshell first side wall, a first clamshell second side wall, a first clamshell third side wall, and a first clamshell fourth side wall arranged in a first parallelepiped with a first open side;

a first clamshell first attachment tube joined to the first clamshell end wall and centrally positioned on the first clamshell first side wall extending toward the first open side;

a second clamshell comprising a second clamshell end wall joined to a second clamshell first side wall, a second clamshell second side wall, a second clamshell third side wall, and a second clamshell fourth side wall arranged in a second parallelepiped with a second open side;

a second clamshell first attachment tube joined to the second clamshell end wall and centrally positioned on the second clamshell first side wall extending toward the second open side;

an attachment bracket having a first side, a second side, a first edge, a second edge, a third edge, and a fourth edge;

a first side first post centrally positioned on the first side at the first edge; and a second side first post centrally positioned on second side at the first edge;

wherein the first side first post is configured to fit into the first clamshell first attachment tube and the second side first post is configured to fit into the second clamshell first attachment tube to join the first clamshell to the second clamshell;

a first clamshell second attachment tube joined to the first clamshell end wall and centrally positioned on the first clamshell second side wall extending toward the first open side;

a second clamshell second attachment tube joined to the second clamshell end wall and centrally positioned on the second clamshell second side wall extending toward the second open side;

a first side second post centrally positioned on the first side at the second edge; and a second side second post centrally positioned on second side at the second edge;

wherein the first side second post is configured to fit into the first clamshell second attachment tube and the second side second post is configured to fit into the second clamshell second attachment tube to join the first clamshell to the second clamshell;

a first clamshell third attachment tube joined to the first clamshell end wall and centrally positioned on the first clamshell third side wall extending toward the first open side;

a second clamshell third attachment tube joined to the second clamshell end wall and centrally positioned on the second clamshell third side wall extending toward the second open side;

a first side third post centrally positioned on the first side at the third edge; and a second side third post centrally positioned on second side at the third edge;

wherein the first side third post is configured to fit into the first clamshell third attachment tube and the second side third post is configured to fit into the second clamshell third attachment tube to join the first clamshell to the second clamshell;

a first clamshell fourth attachment tube joined to the first clamshell end wall and centrally positioned on the first clamshell fourth side wall extending toward the first open side;

a second clamshell fourth attachment tube joined to the second clamshell end wall and centrally positioned on the second clamshell fourth side wall extending toward the second open side;

a first side fourth post centrally positioned on the first side at a fourth edge; and a second side fourth post centrally positioned on second side at the fourth edge;

wherein the first side fourth post is configured to fit into the first clamshell fourth attachment tube and the second side fourth post is configured to fit into the second clamshell fourth attachment tube to join the first clamshell to the second clamshell;

a first clamshell first corner wall joined to the first clamshell end wall, the first clamshell first side wall, and the first clamshell second side wall, extending toward the first open side at a first clamshell first corner;

a second clamshell first corner wall joined to the second clamshell end wall, the second clamshell first side wall, and the second clamshell second side wall, extending toward the second open side at a second clamshell first corner;

a first side first extension tube extending from the first side perpendicular to the first side;

a second side first extension tube extending from the second side perpendicular to the second side;

a first side first magnet disposed upon the first side first extension tube; and a second side first magnet disposed upon the second side first extension tube;

a first clamshell second corner wall joined to the first clamshell end wall, the first clamshell second side wall, and the first clamshell third side wall, extending toward the first open side at a first clamshell second corner;

a second clamshell second corner wall joined to the second clamshell end wall, the second clamshell second side wall, and the second clamshell third side wall, extending toward the second open side at a second clamshell second corner;

a first side second extension tube extending from the first side perpendicular to the first side;

a second side second extension tube extending from the second side perpendicular to the second side;

a first side second magnet disposed upon the first side first extension tube; and a second side second magnet disposed upon the second side second extension tube;

a first clamshell third corner wall joined to the first clamshell end wall, the first clamshell third side wall, and the first clamshell fourth side wall, extending toward the first open side at a first clamshell third corner;

a second clamshell third corner wall joined to the second clamshell end wall, the second clamshell third side wall, and the second clamshell fourth side wall, extending toward the second open side at a second clamshell third corner;

a first side third extension tube extending from the first side perpendicular to the first side;

a second side third extension tube extending from the second side perpendicular to the second side;

a first side third magnet disposed upon the first side third extension tube; and a second side third magnet disposed upon the second side third extension tube;

a first clamshell fourth corner wall joined to the first clamshell end wall, the first clamshell fourth side wall, and the first clamshell first side wall, extending toward the first open side at a first clamshell fourth corner;

a second clamshell fourth corner wall joined to the second clamshell end wall, the second clamshell fourth side wall, and the second clamshell first side wall, extending toward the second open side at a second clamshell fourth corner;

a first side fourth extension tube extending from the first side perpendicular to the first side;

a second side fourth extension tube extending from the second side perpendicular to the second side;

a first side fourth magnet disposed upon the first side fourth extension tube; and a second side fourth magnet disposed upon the second side fourth extension tube;

a first ledge fixed to the first edge and having a thickness greater than the attachment bracket;

a second ledge fixed to the second edge, joined to the first ledge, and having a thickness greater than the attachment bracket;

a third ledge fixed to the third edge, joined to the second ledge, and having a thickness greater than the attachment bracket;

a fourth ledge fixed to the fourth edge, joined to the third ledge and the first edge, and having a thickness greater than the attachment bracket;

a first plate formed by the first ledge, second ledge, third ledge, fourth ledge, and the first side; and a second plate formed by the first ledge, second ledge, third ledge, fourth ledge, and the second side.

2. The magnetic building block of claim 1, wherein:

the first side first extension tube, the first side second extension tube, the first side third extension tube, and the first side fourth extension tube are hollow tubes having a first height;

the first side first post, first side second post, first side third post, and first side fourth post are solid cylinders joined to a paraboloid having a second height;

wherein the first height is at least 50% greater than the second height.

3. The magnetic building block of claim 2, wherein:

the second side first extension tube, the second side second extension tube, the second side third extension tube, and the second side fourth extension tube are hollow tubes having the first height;

the second side first post, second side second post, second side third post, and second side fourth post are solid cylinders joined to a paraboloid having the second height.

* * * * *